US006368170B1

(12) United States Patent
Whiteside et al.

(10) Patent No.: US 6,368,170 B1
(45) Date of Patent: Apr. 9, 2002

(54) MARINE PROPULSION APPARATUS HAVING INTERCHANGEABLE PARTS

(75) Inventors: Mark Whiteside, Zion; Gerald F. Bland, Glenview, both of IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/621,073

(22) Filed: Jul. 21, 2000

(51) Int. Cl.[7] ..... B63H 23/36
(52) U.S. Cl. ..... 440/112; 440/75; 74/378
(58) Field of Search ..... 440/75, 86, 112; 74/378, 355, 376, 379, 416, 423, 606 R

(56) References Cited

U.S. PATENT DOCUMENTS

| | | | | |
|---|---|---|---|---|
| 3,919,964 A | | 11/1975 | Hagen | |
| 3,977,356 A | | 8/1976 | Kroll | |
| 3,994,254 A | | 11/1976 | Woodfill | |
| 4,276,034 A | | 6/1981 | Kashmerick | |
| 4,395,240 A | | 7/1983 | Blanchard | |
| 4,397,198 A | | 8/1983 | Borgensen et al. | |
| 4,428,734 A | | 1/1984 | Ludlow | |
| 4,451,238 A | | 5/1984 | Arnold | |
| 4,558,769 A | | 12/1985 | Neisen | |
| 4,820,209 A | | 4/1989 | Newman | |
| 4,829,846 A | | 5/1989 | DeSalvo et al. | |
| 4,850,911 A | | 7/1989 | Nakahama et al. | |
| 4,861,295 A | | 8/1989 | McElroy, Jr. et al. | |
| 4,863,406 A | | 9/1989 | Bland et al. | |
| 4,867,717 A | | 9/1989 | Burmeister et al. | |
| 4,887,984 A | | 12/1989 | Newman | |
| 4,919,009 A | | 4/1990 | Newman et al. | |
| 4,946,409 A | * | 8/1990 | Suzuki | 440/75 |
| 4,969,370 A | | 11/1990 | Hayasaka | |
| 5,018,996 A | | 5/1991 | Newman et al. | |
| 5,108,324 A | | 4/1992 | Adams et al. | |
| 5,711,742 A | | 1/1998 | Leinonen et al. | |
| 5,836,067 A | | 11/1998 | Cochran | |

* cited by examiner

*Primary Examiner*—Jesus D. Sotelo
(74) *Attorney, Agent, or Firm*—Timothy J. Ziolkowski; Cook & Franke SC

(57) ABSTRACT

A marine propulsion system (10) including a vertical drive unit (12) adapted to have a common upper gear case housing (26) for use with either one of a cone clutch shifting apparatus (60) or a clutch dog shifting apparatus (120). The upper gear case housing is designed to have bearing support surfaces (38) common to both applications and to have a bottom mating surface (27) adapted for attachment to a lower gear case (16) including either a clutch dog shifting apparatus (120) or a non-shifting power transfer apparatus (140). A shift linkage (110) is designed to have a first set of parts (80,82) adapted for connection to the cone clutch shifting apparatus (90) and having a second set of parts (102,104,106) adapted for connection to the clutch dog shifting apparatus (120) and having a third common set of parts (44,48,50) necessary for connection to either the cone clutch shifting apparatus or the clutch dog shifting apparatus.

13 Claims, 7 Drawing Sheets

MARINE PROPULSION APPARATUS HAVING INTERCHANGEABLE PARTS

BACKGROUND OF THE INVENTION

The present invention relates generally to the field of watercraft, and more particularly to a marine propulsion system having interchangeable parts, and specifically to a stern drive vertical drive unit adaptable for use with either a cone clutch or clutch dog shifting apparatus.

Forward-neutral-reverse shifting transmissions are well known in the field of marine propulsion units. U.S. Pat. No. 4,397,198 issued on Aug. 9, 1983 to Borgersen et al. describes one such transmission using what is commonly called a cone clutch shifting apparatus. Cone clutch systems are generally considered to be smooth shifting and capable of handling high power outputs. A less expensive alternative to cone clutch shifting systems is the clutch dog shifting apparatus, such as described in U.S. Pat. No. 4,861,295 issued on Aug. 29, 1989, to McElroy et al. Although typically less smooth shifting than cone clutch shifting systems, clutch dog shifting systems are a preferred choice for lower power propulsion systems, and they may be found on both outboard and stern drive propulsion systems.

Stern drive marine propulsion systems are typically manufactured to have a vertical drive unit including an upper gear case housing and a lower gear case housing. It is common for a cone clutch shifting apparatus to be housed in an upper gear case housing, while it is common for a clutch dog shifting apparatus to be housed in a lower gear case housing. An upper gear case housing incorporating a cone clutch shifting apparatus will be mated with a lower gear case housing containing a non-shifting power transfer apparatus to translate the vertical rotation of the vertical drive unit drive shaft into horizontal rotation of the propeller shaft. A typical non-shifting power transfer apparatus utilizes mating bevel gears disposed at right angles to each other. Similarly, the lower gear case housing of a stern drive propulsion system incorporating a clutch dog shifting apparatus will be mated with an upper gear case housing containing a non-shifting power transfer apparatus to translate the horizontal rotation of the engine drive shaft into vertical rotation of the vertical drive unit drive shaft.

The availability of both the cone clutch shifting system and the clutch dog shifting apparatus allows the manufacturer of marine propulsion systems to offer a variety of drive options to its customers. However, designing, manufacturing, and inventorying all of the individual parts necessary to provide such options can be very costly and space consuming.

BRIEF SUMMARY OF THE INVENTION

Thus, there is described herein a marine propulsion system that can be configured with either a cone clutch shifting apparatus or a clutch dog shifting apparatus. A marine stern drive vertical drive unit is described herein that includes an upper gear case housing adapted for supporting either a cone clutch shifting apparatus or a non-shifting power transfer apparatus. The upper gear case housing incorporates an input shaft pinion and bearing arrangement adapted to engage the drive gear(s) of either of the cone clutch shifting apparatus or the non-shifting power transfer apparatus. The upper gear case housing also includes a lower mating surface adapted for attachment to a lower gear case housing including either a non-shifting power transfer apparatus or a clutch dog shifting apparatus, respectively.

Further, a shifting linkage is described herein that is adaptable for use in the vertical drive unit with either the cone clutch shifting apparatus or the clutch dog shifting apparatus. The shifting linkage includes a dual function shift cable and shift cable lever, along with interchangeable cone clutch and clutch dog shift links and connecting hardware.

BRIEF DESCRIPTION OF THE DRAWINGS

The features and advantages of the present invention will become apparent from the following detailed description of the invention when read with the accompanying drawings. Identical or similar parts illustrated in more than one figure may be numbered consistently between the drawings.

DETAILED DESCRIPTION OF THE INVENTION

Figure 1:
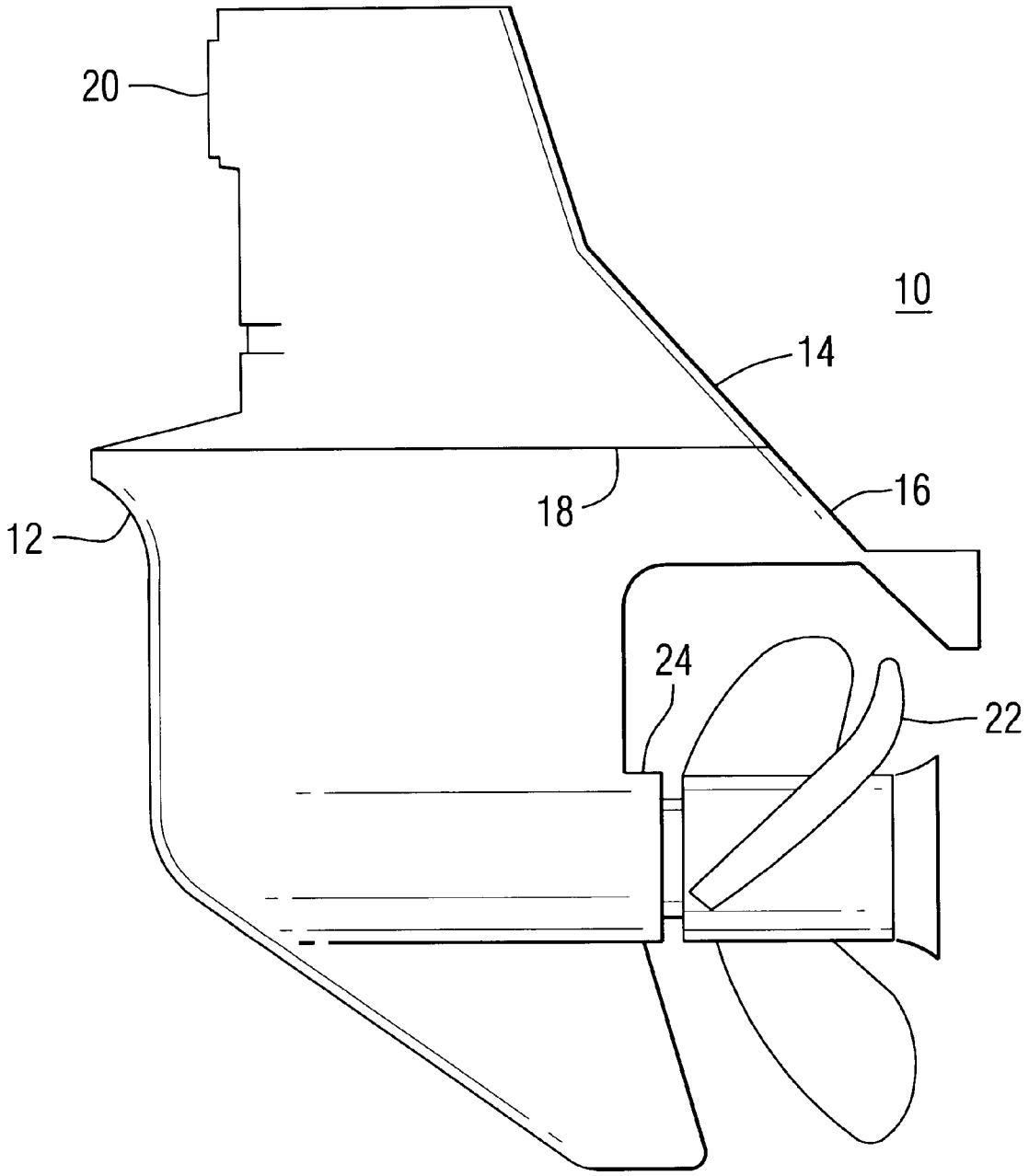
FIG. 1 is a plan view of the vertical drive unit of a stern drive marine propulsion system.

FIG. 1 illustrates a rearward portion of a marine propulsion system 10 showing a vertical drive unit 12 having an upper gear case 14 sealingly attached to a lower gear case 16 along a mating surface 18. The vertical drive unit 12 is adapted to be rotatingly attached to a gimbal housing (not shown) and to be disposed rearward of the transom of a watercraft, as is well known in the art. The vertical drive unit contains internal gearing and shafts, as will be described more fully below, adapted to receive power from an engine drive shaft extending into the upper gear case at an input end 20, and to transmit that power to a propeller 22 disposed at an output end 24. The vertical drive unit 12 provides for selectable engagement between the engine and the propeller 22 in any one of a forward, reverse or neutral drive gear using one of a cone clutch shifting apparatus disposed in the upper gear case 14 or a clutch dog shifting apparatus disposed in the lower gear case 16. In the embodiment illustrated in FIG. 1, there is no external difference in the vertical drive unit 12 between the cone clutch embodiment and the clutch dog embodiment, since both shifting systems are designed to be installed in common upper and lower gear case housings. In another embodiment, a common upper gear case housing may be utilized with different lower gear case housings depending upon whether the shifting apparatus is a cone clutch shifting apparatus or a clutch dog shifting apparatus.

Figure 2:
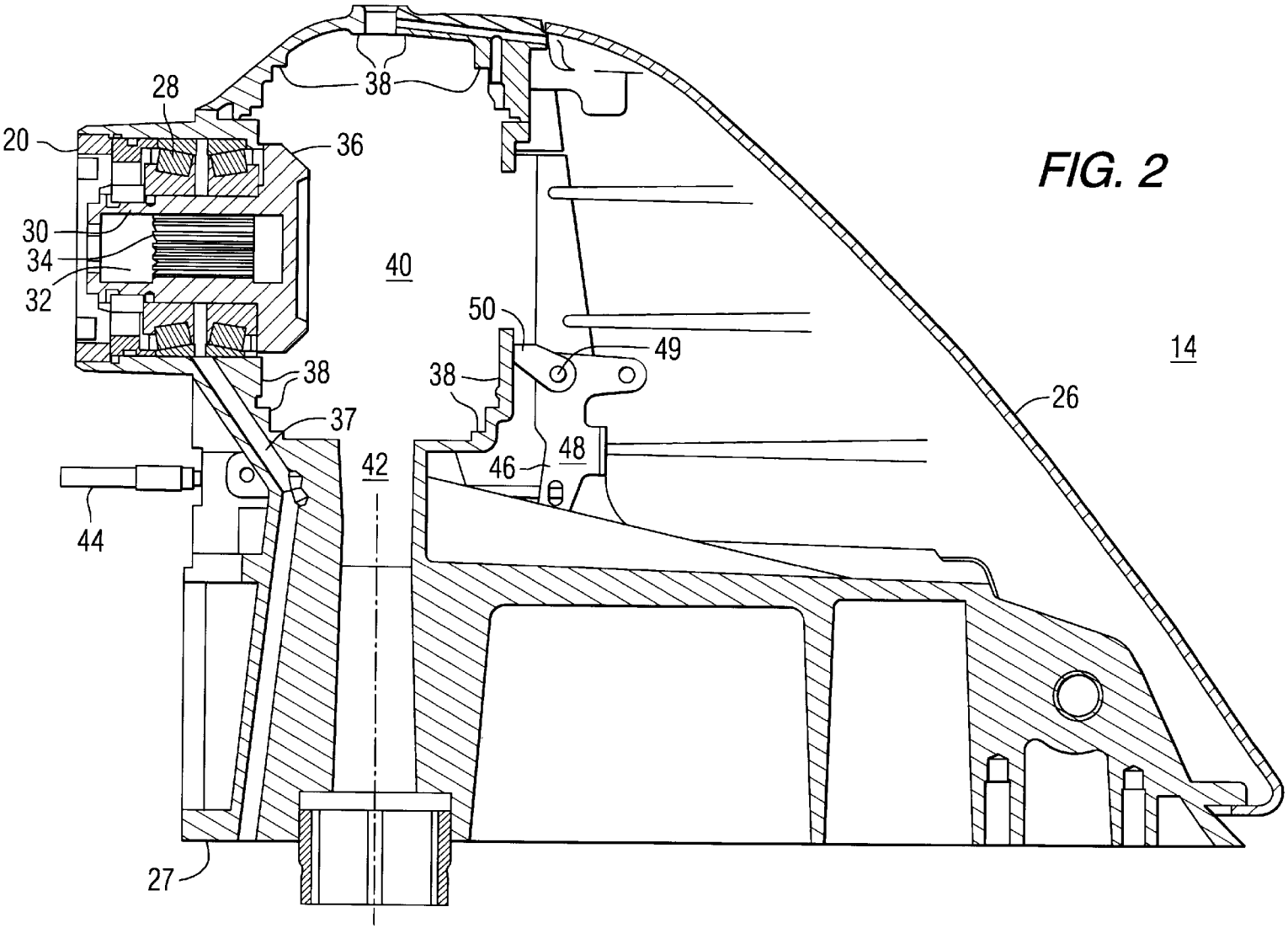
FIG. 2 is a partial cross-sectional view of a stern drive upper gear case housing illustrating parts common to both a cone clutch shifting apparatus and a clutch dog shifting apparatus.

FIG. 2 is a partial cross sectional view of an upper gear case 14 illustrating those parts that are common for both a cone clutch shifting apparatus in the upper gear case and a clutch dog shifting apparatus in the lower gear case. The inventors have found that a single upper gear case housing 26 may be used for both applications by specially designing certain bearing and mating surfaces into the housing. Upper gear case 14 includes an upper housing 26 having an input end 20 and a lower mating surface 27 adapted for attachment alternatively to a lower gear case having no shifting apparatus or to a lower gear case having a clutch dog shifting apparatus. Input end 20 of housing 26 includes surfaces for the support of a double acting thrust bearing 28, which in turn rotatably supports input pinion gear 30 within housing 26. Pinion gear 30 includes a center bore 32 containing threads 34 for receiving an input drive shaft (not shown) connected to an engine preferably through a universal joint coupler. Pinion gear 30 also includes a bevel gear end 36 adapted for being engaged to mating bevel gear(s) of either a cone clutch shifting apparatus or a non-shifting power transfer apparatus, as will be illustrated and described with regard to FIGS. 3 and 4 below. An oil passage 37 is formed through housing 26 for the delivery of lubricant to bearing 28.

Housing 26 includes one or more bearing support surfaces 38 adapted to support corresponding bearings of either a cone clutch shifting apparatus or a non-shifting power transfer apparatus as will be discussed more fully below. Bearing support surfaces 38 generally surround and define a volume 40 designed to accommodate the appropriate shifting or power transfer apparatus. An opening 42 is defined by the housing 26 for accommodating a vertical drive shaft for either such apparatus.

Upper gear case 14 also includes a shift cable 44 connected to a first side 46 of a shift cable lever 48. Shift cable lever 48 is rotatingly supported at pivot point 49 by a cone clutch cover housing 50 attached to housing 26.

Figure 3:
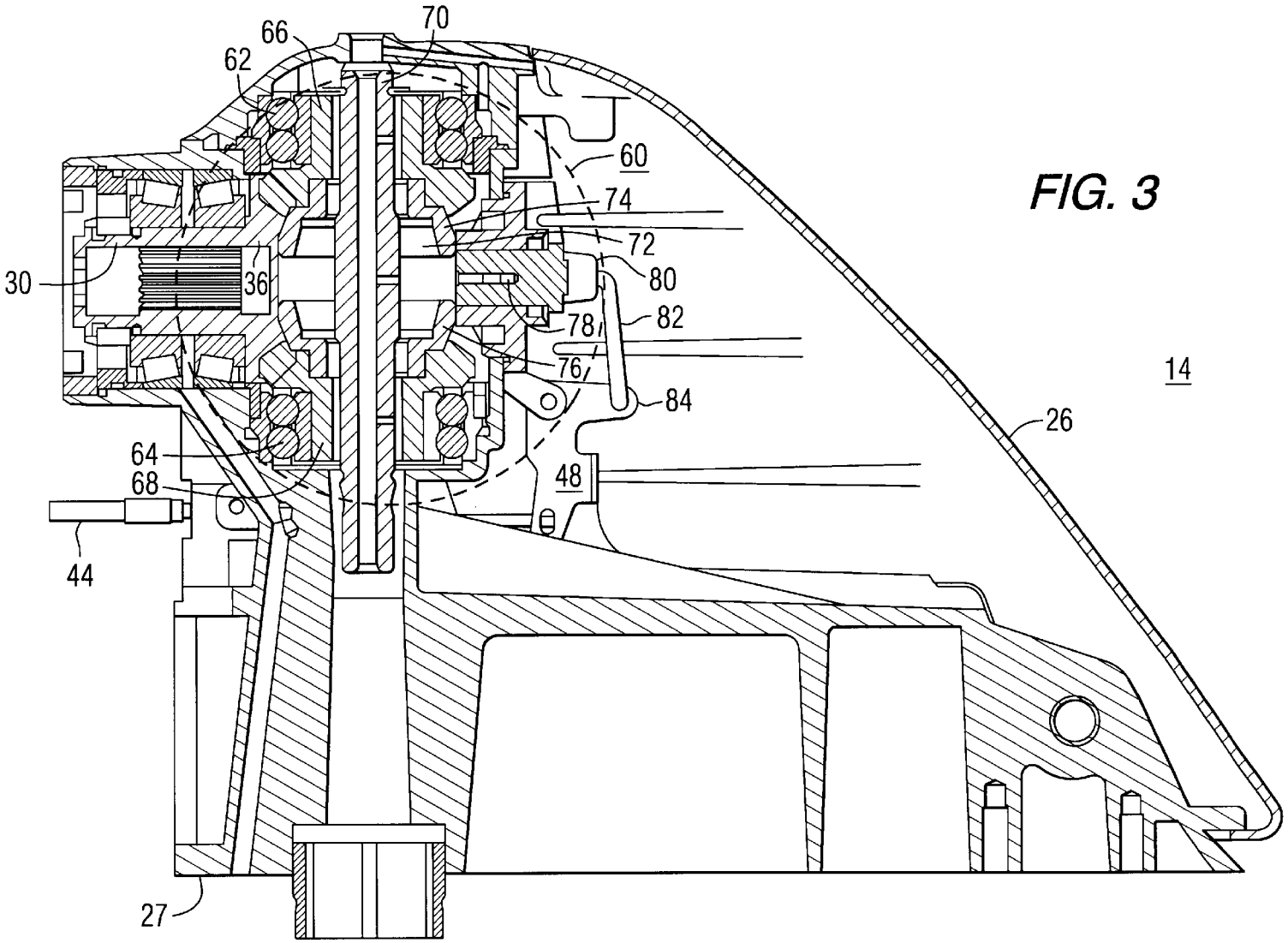
FIG. 3 is a partial cross-sectional view of the upper gear case housing of FIG. 2 illustrating the installation of parts used for a cone clutch shifting apparatus.

FIG. 3 illustrates a cross-sectional view of the upper gear case 14 of FIG. 2 with the addition of parts used for a cone clutch shifting apparatus 60. Bearing support surfaces 38 are in contact with upper and lower double roll ball bearings 62, 64 for the support of forward drive bevel gear 66 and reverse drive bevel gear 68 respectively. Forward drive bevel gear 66 and reverse drive bevel gear 68 are engaged with respective opposite sides of the bevel gear end 36 of input pinion gear 30, and thereby are driven to rotate in opposite directions about vertical drive shaft 70. Cone clutch shifting apparatus 60 also includes a cone 72 which is splined to the vertical drive shaft 70 for common rotation therewith. Cone 72 is movable axially of the vertical drive shaft 70 for selective and alternative engagement with the forward drive bevel gear 66 and reverse drive bevel gear 68 through respective cups 74,76. Cone 72 is moved axially by the vertical movement of pin 78 which is, in turn, driven by the operation of a cone clutch shift lever 80 attached by a cone shift link 82 to a second side 84 of shift cable lever 48. Selective movement of shift cable 44 will drive cone 72 into engagement with either forward drive bevel gear 66 for forward rotation of vertical drive shaft 70 or reverse drive bevel gear 68 for reverse rotation of vertical drive shaft 79 or a neutral position not engaged with either bevel gear.

Figure 4:
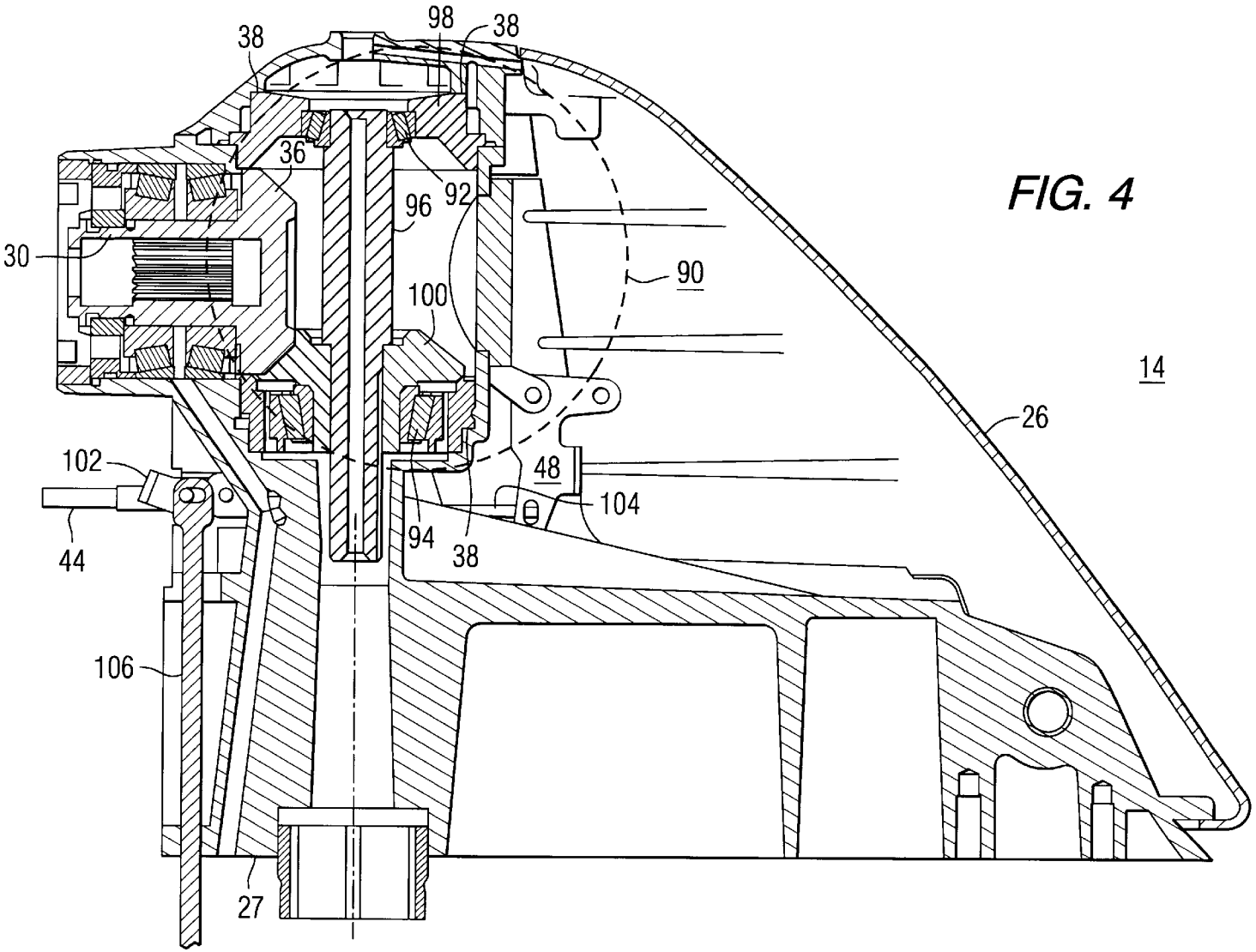
FIG. 4 is a partial cross-sectional view of the upper gear case housing of FIG. 2 illustrating the installation of parts used for a non-shifting power transfer apparatus.

FIG. 4 illustrates a cross-sectional view of the upper gear case 14 of FIG. 2 with the addition of parts used for a non-shifting power transfer apparatus 90. Bearing support surfaces 38 are in contact with upper and lower tapered roller bearings 92,94 for the support of vertical drive shaft 96. Bearing support spacer 98 is used to accommodate the distance between upper tapered roller bearing 92 and its respective bearing support surface 38. Alternatively, housing 26 could be formed to have the bearing support surfaces extend to the required dimensions for the non-shifting power transfer apparatus 90, with some amount of machining being necessary for the installation of the cone clutch shifting apparatus 60 of FIG. 3. Vertical drive shaft 96 is splined to rotate with an output bevel gear 100 which is in engagement with bevel gear end 36 of pinion gear 30. This mechanism is operable to drive vertical drive shaft 96 in a single direction together with an engine drive shaft engaged with input pinion gear 30.

No shifting is accomplished in the upper gear case 14 in the embodiment of FIG. 4, however, the upper gear case housing 26 is adapted to support a clutch dog shift lever 102 attached at a first side to shift cable lever 48 by a clutch dog shift link 104. A clutch dog shift rod 106 is attached to a second side of clutch dog shift lever 102 and extends downward into an attached lower gear case housing containing a clutch dog shifting apparatus, as will be described more fully below.

Figure 5:
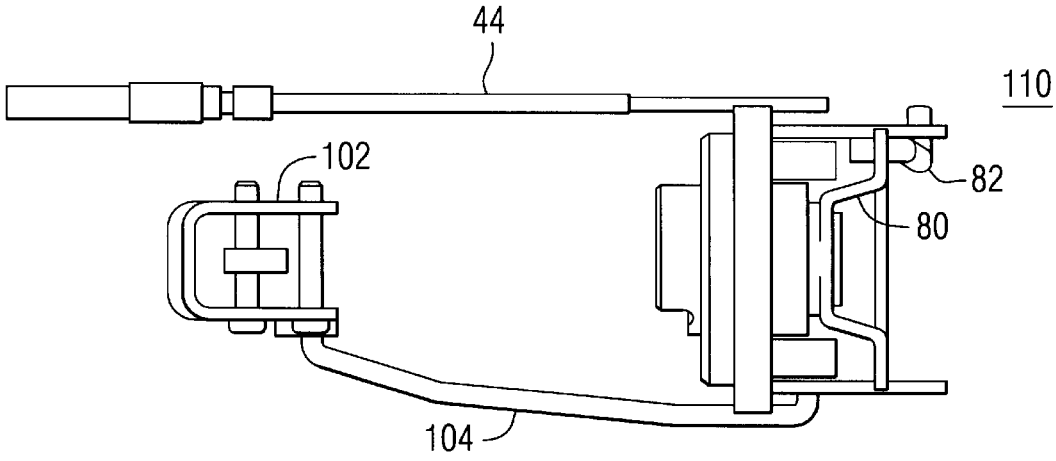
FIG. 5 is a top view of a shift linkage adapted for use with either a cone clutch shifting apparatus or a clutch dog shifting apparatus.
Figure 6:
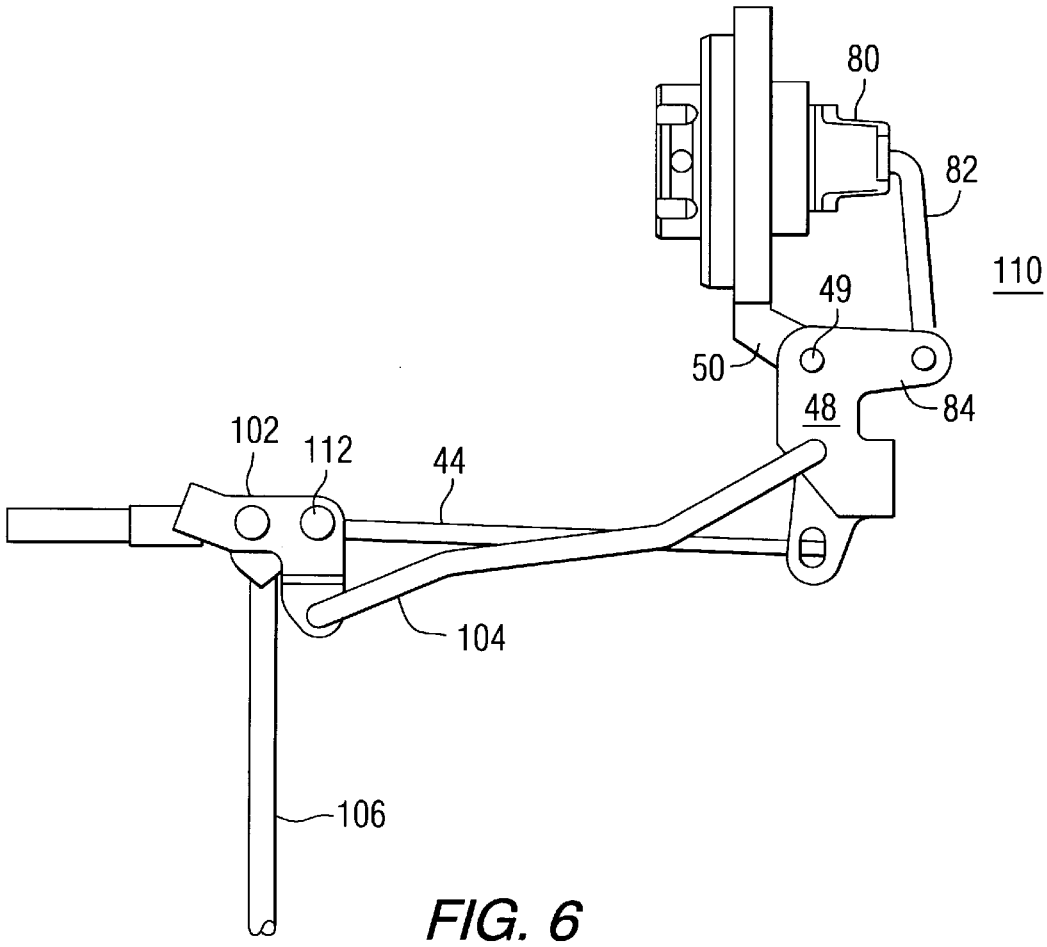
FIG. 6 is a side elevation view of the shift linkage of FIG. 5.

The shifting linkages shown in FIGS. 3 and 4 may be seen more clearly in FIGS. 5 and 6. A single shift linkage assembly 110 is adapted for use with either a cone clutch shifting apparatus 60 contained in an upper gear case 14 or a clutch dog shifting apparatus contained in a lower gear case 16 by the simple removal or replacement of selected parts. A shift cable 44 is connected to a shifter (not shown) located within the watercraft for movement by an operator. The cable 44 is connected to shift cable lever 48 which is supported at a pivot point 49 by cone clutch cover housing 50. For cone clutch applications, a second side 84 of shift cable lever 48 is removably connected to a cone clutch shift link 82 for the movement of the removable cone clutch shift lever 80 and corresponding movement of pin 78 (seen in FIG. 3). For clutch dog shifting apparatus applications, the cone clutch shift link 82, cone clutch shift lever 80 and pin 78 are not installed, but in their place the clutch dog shifting parts are used. For a clutch dog shifting apparatus application, a clutch dog shift link 104 is removably attached to the shift cable lever 48 and to a clutch dog shift lever 102 rotatably supported about pivot point 112 by the upper gear case housing 26. A clutch dog shift rod 106 is also connected to clutch dog shift lever 102 for providing shifting input movements from the shift cable 44 to the clutch dog shifting apparatus located in the lower gear case 16. The removability and interchangeability of the various parts of the shift linkage assembly 110 allows this single mechanism to function for both applications, thereby reducing the number of parts that need be maintained in inventory.

Figure 7:
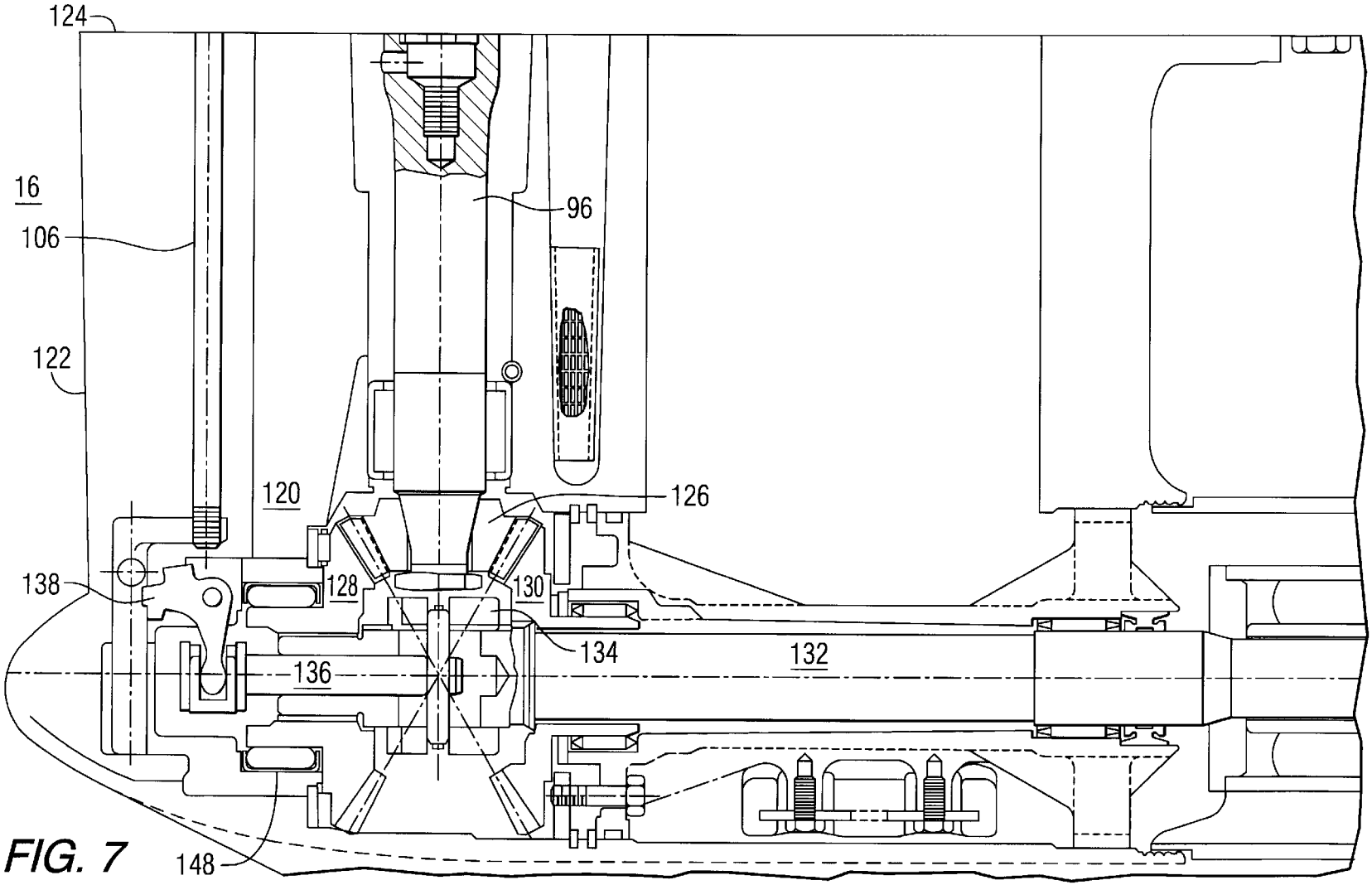
FIG. 7 is a partial cross-sectional view of a stern drive lower gear case housing illustrating the installation of parts used for a clutch dog shifting apparatus as may be mated to the upper gear case housing of FIG. 4.

FIG. 7 illustrates a lower gear case 16 containing a clutch dog shifting apparatus 120 designed to be attached to the upper gear case 14 of FIG. 4 having a non-shifting power transfer apparatus. Lower gear case 16 includes a lower gear case housing 122 adapted for attachment to upper gear case housing 26 along a mating surface 124. Mating surface 124 is designed for sealing attachment to mating surface 27 of upper gear case housing 26 as shown in FIG. 2. Vertical drive shaft 96 extends from upper gear case housing 26 into lower gear case housing 122 and is splined to bevel gear 126. Bevel gear 126 is engaged on opposed sides to forward bevel gear 128 and reverse bevel gear 130 which are spaced apart for counter-rotation about the centerline of propeller shaft 132. Propeller shaft 132 to connected to propeller 22 as illustrated on FIG. 1. A clutch dog 134 is splined to the exterior of the propeller shaft 132 for common rotation therewith and is movable axially of the propeller shaft 132 for selective and alternative engagement with forward bevel gear 128 and reverse bevel gear 130. An actuator 136 extends through an axial bore in the propeller shaft 132 and is moveable axially along the bore of the propeller shaft 132. Actuator is connected to clutch dog 134 and to a first side of clutch dog bell crank 138. A second opposed side of clutch dog bell crank 138 is connected to clutch dog shift rod 106 for selective movement by an operator, thereby selectively moving clutch dog 134 from a forward drive position, to a neutral position, or to a reverse drive position.

Figure 8:
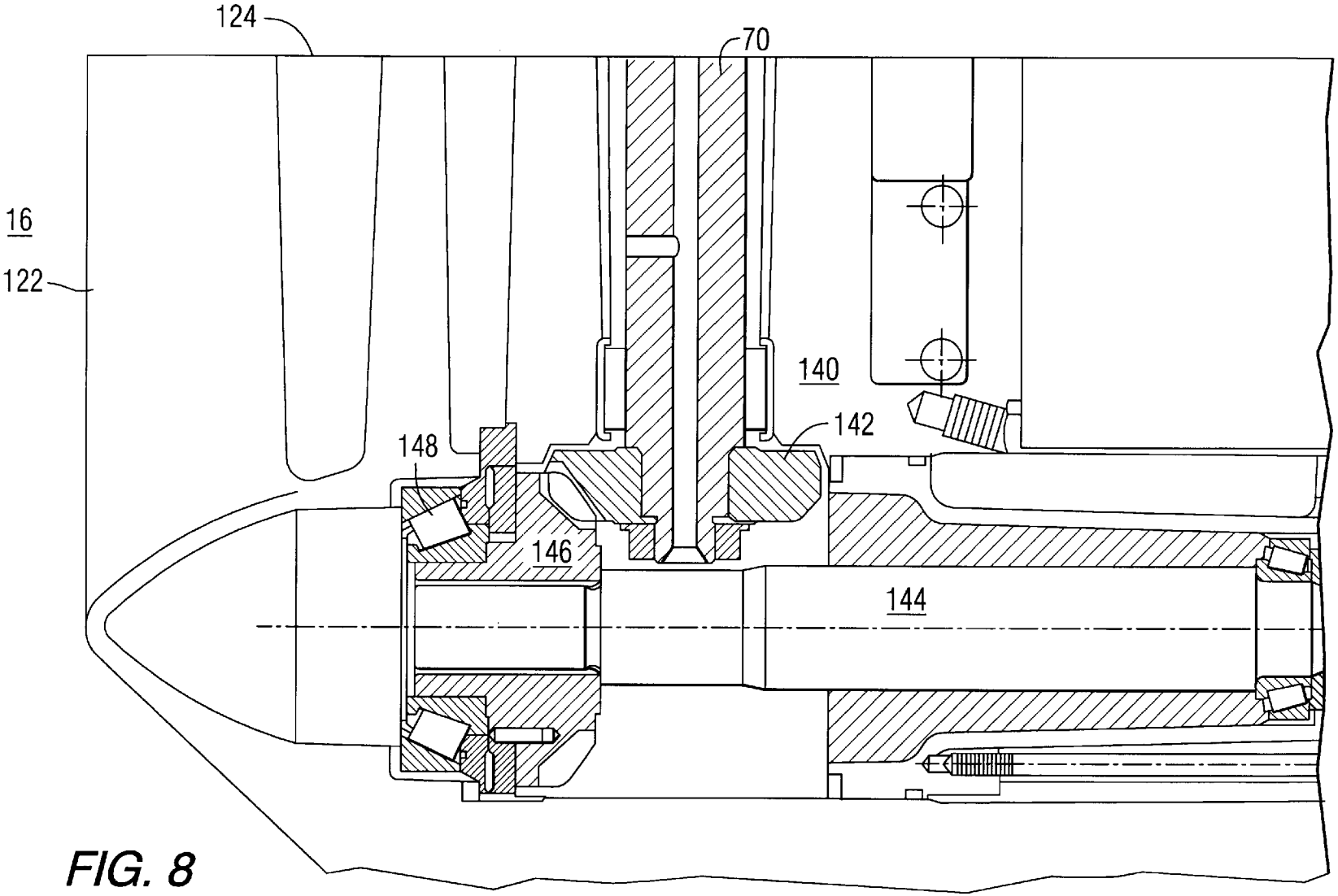
FIG. 8 is a partial cross-sectional view of a stern drive lower gear case housing illustrating the installation of parts used for a non-shifting power transfer apparatus as may be mated to the upper gear case housing of FIG. 3.

FIG. 8 illustrates a lower gear case 16 containing a non-shifting power transfer apparatus 140 for attachment to the upper gear case 14 containing a cone clutch shifting apparatus 60 as illustrated in FIG. 3. In one embodiment, the lower gear case housing 122 for this application is made to be identical to the lower gear case housing 122 for the clutch dog shifting apparatus application of FIG. 7. Alternatively, two different lower gear case housings may be used for the two different applications, however, each such lower gear case housing should be adapted to have an upper mating surface 124 adapted for sealing attachment to the upper gear case housing 26. In the embodiment of FIG. 8, vertical drive shaft 70 is splined to bevel gear 142 and propeller shaft 144 is splined to bevel gear 146. The engagement of bevel gears 142, 146 causes propeller shaft 144 and attached propeller 22 to rotate in response to the vertical rotation of vertical drive shaft 70. In order for a single lower gear case housing 122 to be adapted for use with both a clutch dog shifting apparatus 120 and a non-shifting power transfer apparatus 140, the various bearing support surfaces 148 associated with these two applications must be designed to be identical or to be easily modified from one application to the other by machining or the installation of appropriate spacers.

Thus, it may be appreciated that the number of component designs necessary for providing an option of selecting a marine vertical drive unit having a cone clutch shift apparatus 60 or having a clutch dog shift apparatus 120 may be minimized by designing an upper gear case 14 to include bearing support surfaces 38 adapted for supporting alternatively a cone clutch shift apparatus 60 or a non-shifting power transfer apparatus 90, and having a lower mating surface 27 adapted for attachment alternatively to a lower gear case having no shifting apparatus or to a lower gear case having a clutch dog shifting apparatus 120. A cone clutch shifting apparatus 90 may thereby be designed to be installed into the upper gear case housing 26, and a non-shifting power transfer apparatus 90 may be designed to be installed into the same upper gear case housing 26. The upper gear case housing 26 and the appropriate one of the cone clutch shifting apparatus 60 and the non-shifting power transfer apparatus 90 may then be manufactured and assembled. A lower gear case 16 may then be selected to have a non-shifting power transfer apparatus 140 or a clutch dog shifting apparatus 120, as appropriate, and attached to the upper gear case housing 14 along a mating surface 18. Preferably, the input shaft pinion gear 30 and bearing arrangement 28 of the upper gear case 14 are designed to be the same for both the cone clutch shift apparatus 60 and the non-shifting power transfer apparatus 90. A shift linkage 110 may be designed for installation into the upper gear case housing 26 to have a first set of parts 80, 82 adapted for connection to the cone clutch shifting apparatus 90 and having a second set of parts 102, 104, 106 adapted for connection to the clutch dog shifting apparatus 120, and having a third common set of parts 44, 48, 50 necessary for connection to either the cone clutch shifting apparatus 90 or the clutch dog shifting apparatus 120. The shift linkage 110 may then be manufactured and installed to have either the first and third set of parts or the second and third set of parts respectively once it is determined if the shifting apparatus is a cone clutch shifting apparatus 90 in the upper gear case housing 26 or a clutch dog shifting apparatus 120 in the lower gear case housing 122. By designing an upper gear case housing 26 adapted for use with either application, the quantity of upper gear case housings 26 manufactured from a single design will thereby be increased, the unit cost of such housings will be decreased, and the cost and space necessary for inventory will be decreased.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A method of providing a vertical drive unit for a marine propulsion apparatus, the method comprising the steps of:

designing an upper gear case housing;

designing a cone clutch shifting apparatus adapted for installation into the upper gear case housing;

designing a non-shifting power transfer apparatus adapted for installation into the upper gear case housing;

manufacturing the upper gear case housing;

manufacturing either the cone clutch shifting apparatus or the non-shifting power transfer apparatus;

installing either the cone clutch shifting apparatus or the non-shifting power transfer apparatus into the upper gear case housing;

attaching a lower gear case housing to the upper gear case housing, the lower gear case housing selected to have a non-shifting power transfer apparatus if the upper gear case housing contains the cone clutch shifting apparatus or selected to have a clutch dog shifting apparatus if the upper gear case housing contains a non-shifting power transfer apparatus.

2. The method of claim 1, further comprising the step of designing an input shaft pinion gear and bearing arrangement for the upper gear case housing adapted for alternative connection with either the cone clutch shifting apparatus or the non-shifting power transfer apparatus.

3. The method of claim 1, further comprising the step of designing a plurality of bearing support surfaces in the upper gear case housing adapted for alternative support of either the cone clutch shifting apparatus or the non-shifting power transfer apparatus.

4. The method of claim 1, further comprising the steps of:

designing a shift linkage adapted for installation into the upper gear case housing and having a first set of parts adapted for connection to the cone clutch shifting apparatus and having a second set of parts adapted for connection to the clutch dog shifting apparatus and having a third common set of parts necessary for connection to either the cone clutch shifting apparatus or the clutch dog shifting apparatus;

manufacturing the shift linkage with the first set of parts and the third set of parts if the upper gear case housing contains a cone clutch shifting apparatus and the lower gear case housing contains a non-shifting power transfer apparatus, or manufacturing the shift linkage with the second set of parts and the third set of parts if the upper gear case housing contains a non-shifting power transfer apparatus and the lower gear case housing contains a clutch dog shifting apparatus; and installing the shift linkage into the upper gear case housing prior to the step of attaching a lower gear case housing to the upper gear case housing.

5. A method of minimizing the number of component designs necessary for providing an option of selecting a marine vertical drive unit having a cone clutch shifting apparatus or having a clutch dog shifting apparatus, the cone clutch shifting apparatus being housed in an upper gear case of a vertical drive unit and the clutch dog shifting apparatus being housed in a lower gear case of a vertical drive unit, the method comprising the steps of:

designing an upper gear case to include an upper gear case housing having bearing support surfaces adapted for supporting alternatively a cone clutch shifting apparatus or a non-shifting power transfer apparatus and having a lower mating surface adapted for attachment alternatively to a lower gear case having no shifting apparatus or to a lower gear case having a clutch dog shifting apparatus;

designing a cone clutch shifting apparatus adapted for installation into the upper gear case housing;

designing a non-shifting power transfer apparatus adapted for installation into the upper gear case housing;

designing a lower gear case adapted for attachment to the upper gear case housing and having a non-shifting power transfer apparatus;

designing a lower gear case adapted for attachment to the upper gear case housing and having a clutch dog shifting apparatus.

6. The method of claim 5, further comprising the step of designing a shift linkage adapted for alternative use with either the cone clutch shifting apparatus or with the clutch dog shifting apparatus.

7. In the manufacturing of marine propulsion units, a method of increasing the quantity of upper gear case housings manufactured from a single design, the method comprising the steps of:

designing an upper gear case housing having bearing support surfaces adapted for supporting in the alternative either a cone clutch shifting apparatus or a non-shifting power transfer apparatus;

designing the upper gear case housing to have a mating surface adapted for interchangeably being attached to either a lower gear case housing containing no shifting apparatus or to a lower gear case housing containing a clutch dog shifting apparatus.

8. The method of claim 7, further comprising the steps of:

designing a cone clutch shifting apparatus adapted for installation into the upper gear case housing and being supported by the bearing support surfaces;

designing a non-shifting power transfer apparatus adapted for installation into the upper gear case housing and being supported by the bearing support surfaces.

9. The method of claim 8, further comprising the steps of:

designing a lower gear case housing adapted for attachment to the upper gear case housing and for containing a non-shifting power transfer apparatus; and designing a lower gear case housing adapted for attachment to the upper gear case housing and for containing a clutch dog shifting apparatus.

10. A shift linkage arrangement for a marine vertical drive unit, the shift linkage comprising:

a shift cable;

a shift cable lever pivotally supported within the vertical drive unit and having a first side attached to the shift cable;

a cone clutch shift link removably attached to a second side of the shift cable lever;

a cone clutch shift lever removably attached to the cone clutch shift link;

a clutch dog shift link removably attached to the shift cable lever;

a clutch dog shift lever pivotally supported within the vertical drive unit and having a first side attached to the clutch dog shift link;

a clutch dog shift rod attached to a second side of the clutch dog shift lever;

wherein the shift linkage arrangement is adapted for use with a cone clutch shifting apparatus by removing the clutch dog shift link, the clutch dog shift lever and the clutch dog shift rod; and wherein the shift linkage arrangement is adapted for use with a clutch dog shifting apparatus by removing the cone clutch shift link and the cone clutch shift lever.

11. A method of assembling a shift linkage for a stern drive marine transmission for use with either a cone clutch shifting apparatus in an upper gear case housing of the transmission or for use with a clutch dog shifting apparatus in a lower gear case housing of the transmission, the method comprising the steps of:

attaching a cone clutch lever housing to the upper gear case housing;

pivotally attaching a shift cable lever to the cone clutch lever housing;

attaching a shift cable to a first side of the shift cable lever;

determining if the shifting apparatus is a cone clutch shifting apparatus in the upper gear case housing or a clutch dog shifting apparatus in the lower gear case housing;

if the shifting apparatus is determined to be a cone clutch shifting apparatus, attaching a cone clutch shift lever to the cone clutch lever housing and interconnecting the cone clutch shift lever and the shift cable lever with a cone clutch shift link; and if the shifting apparatus is determined to be a clutch dog shifting apparatus, pivotally attaching a clutch dog shift lever to the upper gear housing, the clutch dog shift lever adapted for attachment to a clutch dog shift rod, and interconnecting the clutch dog shift lever and the shift cable lever with a clutch dog shift link.

12. In a marine stem drive apparatus having a vertical drive unit with an upper gear case housing and a lower gear case, the improvement comprising the upper gear case housing being adapted for alternative use with either one of a cone clutch shifting apparatus installed in the upper gear case housing and for use with a clutch dog shifting apparatus installed in the lower gear case.

13. In a marine stern drive apparatus having a vertical drive unit with an upper gear case and a lower gear case, the improvement comprising:

a plurality of support surfaces formed in an upper gear case housing of the upper gear case and adapted for alternatively supporting either a cone clutch shifting apparatus or a non-shifting power transfer apparatus; and a mating surface formed on the upper gear case housing and adapted for alternative attachment to either a lower gear case housing containing no shifting apparatus or to a lower gear case housing containing a clutch dog shifting apparatus.

* * * * *